US008088460B2

(12) United States Patent
Looijé et al.

(10) Patent No.: US 8,088,460 B2
(45) Date of Patent: Jan. 3, 2012

(54) DISPOSABLE VASE

(76) Inventors: Leopold Looijé, Vlaardingen (NL); Liduina Petronella Josephina Looijé-Schoenmakers, Vlaardingen (NL)

( * ) Notice: Subject to any disclaimer, the term of this patent is extended or adjusted under 35 U.S.C. 154(b) by 953 days.

(21) Appl. No.: 12/045,250

(22) Filed: Mar. 10, 2008

(65) Prior Publication Data

US 2008/0206501 A1 Aug. 28, 2008

Related U.S. Application Data

(63) Continuation-in-part of application No. PCT/NL2006/000446, filed on Sep. 8, 2006.

(30) Foreign Application Priority Data

Sep. 9, 2005 (NL) ..... 1029917
Nov. 11, 2005 (NL) ..... 1030400

(51) Int. Cl.
*B29D 22/00* (2006.01)
*B29D 23/00* (2006.01)
*B32B 1/08* (2006.01)
*B65D 1/02* (2006.01)

(52) U.S. Cl. ..... 428/35.7; 428/36.9; 428/36.92; 428/34.1; 428/480; 220/DIG. 30; 206/524.7; 264/478; 264/328.1

(58) Field of Classification Search ..... 428/34.1, 428/35.7, 36.9, 36.92, 480; 264/36.15, 478, 264/328.1; 220/DIG. 30; 206/524.7
See application file for complete search history.

(56) References Cited

U.S. PATENT DOCUMENTS 5,516,562 A 5/1996 Edwards
5,924,560 A 7/1999 Swart
6,903,053 B2 * 6/2005 Noda et al. ..... 504/360
2006/0091148 A1 5/2006 Berg

FOREIGN PATENT DOCUMENTS

| | | |
|---|---|---|
| EP | 0966907 | 12/1999 |
| NL | 1022294 | 1/2004 |
| WO | WO 91/05715 | 5/1991 |
| WO | WO 96/12662 | 5/1996 |
| WO | WO 98/30137 | 7/1998 |
| WO | WO 2004069009 | 8/2004 |
| WO | WO 2007/063361 | 6/2007 |
| WO | WO 2007/099427 | 9/2007 |

OTHER PUBLICATIONS

Official Search Report of the European Patent Office in counterpart foreign application No. PCT/NL2006/000446 filed Sep. 8, 2006.

* cited by examiner

*Primary Examiner* — Michael C Miggins
(74) *Attorney, Agent, or Firm* — Steven M. Koehler; Westman, Champlin & Kelly, P.A.

(57) ABSTRACT

A disposable vase comprises biodegradable material. In one embodiment, the wall of the vase is made of a plastic selected from a biodegradable polymer selected from a polyester and a polymer derived from starch or a mixture thereof, wherein the polymer has a thickness that allows the vase to retain its shape. When it becomes street litter, such a vase decomposes relatively fast. The biodegradable plastic can be selected from polylactates and polyhydroxyalkanoates. Preferably the polyhydroxyalkanoate is chosen from polyhydroxybutanoate, polyhydroxyoctanoate, polyhydroxyvalerate and mixtures thereof. The excellent plastic properties of these polyesters also offer possibilities for use at home, since their environment-friendly character permits the owner of the vase to discard, without feeling embarrassed, a vase that he or she considers less beautiful or of which he or she is tired, and to buy another vase.

24 Claims, 4 Drawing Sheets

DISPOSABLE VASE

CROSS-REFERENCE TO RELATED APPLICATION

The present application is a continuation-in-part application under 35 U.S.C. Section 120 of and claims priority of International patent application Ser. No. PCT/NL2006000446, filed Sep. 8, 2006, and published in English.

BACKGROUND

The discussion below is merely provided for general background information and is not intended to be used as an aid in determining the scope of the claimed subject matter.

Aspects of the present invention relate to a disposable vase comprising biodegradable material.

Especially cut flowers are placed in vases, said vases serving to provide the cut flowers with water and to determine the arrangement of the cut flowers. In certain cases, such as at cemeteries and in hospitals, it is advantageous to have a disposable vase at one's disposal. Such a vase is known, e.g., from NL 1022294 which patent claims a vase made of a paper-like material which at its interior is provided with a plastic liner preferably made of polyethylene or a biodegradable plastic such as a polymer-based starch. These disposable vases are essentially identical to cups used for soft drinks, and are essentially just as unattractive.

SUMMARY

This Summary and Abstract are provided to introduce some concepts in a simplified form that are further described below in the Detailed Description. This Summary and Abstract are not intended to identify key features or essential features of the claimed subject matter, nor are they intended to be used as an aid in determining the scope of the claimed subject matter. In addition, the description herein provided and the claimed subject matter should not be interpreted as being directed to addressing any of the short-comings discussed in the Background.

An aspect of the present invention is a disposable vase having a wall which is made of a plastic selected from a biodegradable polymer selected from a polyester and a polymer derived from starch or a mixture thereof, wherein the polymer has a thickness that allows the vase to retain its shape.

Another aspect of the present invention is a disposable vase having a wall which is made of a plastic selected from a biodegradable polymer selected from a polyester, a polymer derived from starch and a protein or a mixture thereof, wherein the polymer has a thickness that allows the vase to retain its shape.

DETAILED DESCRIPTION OF THE EXEMPLARY EMBODIMENTS

Figure 1:
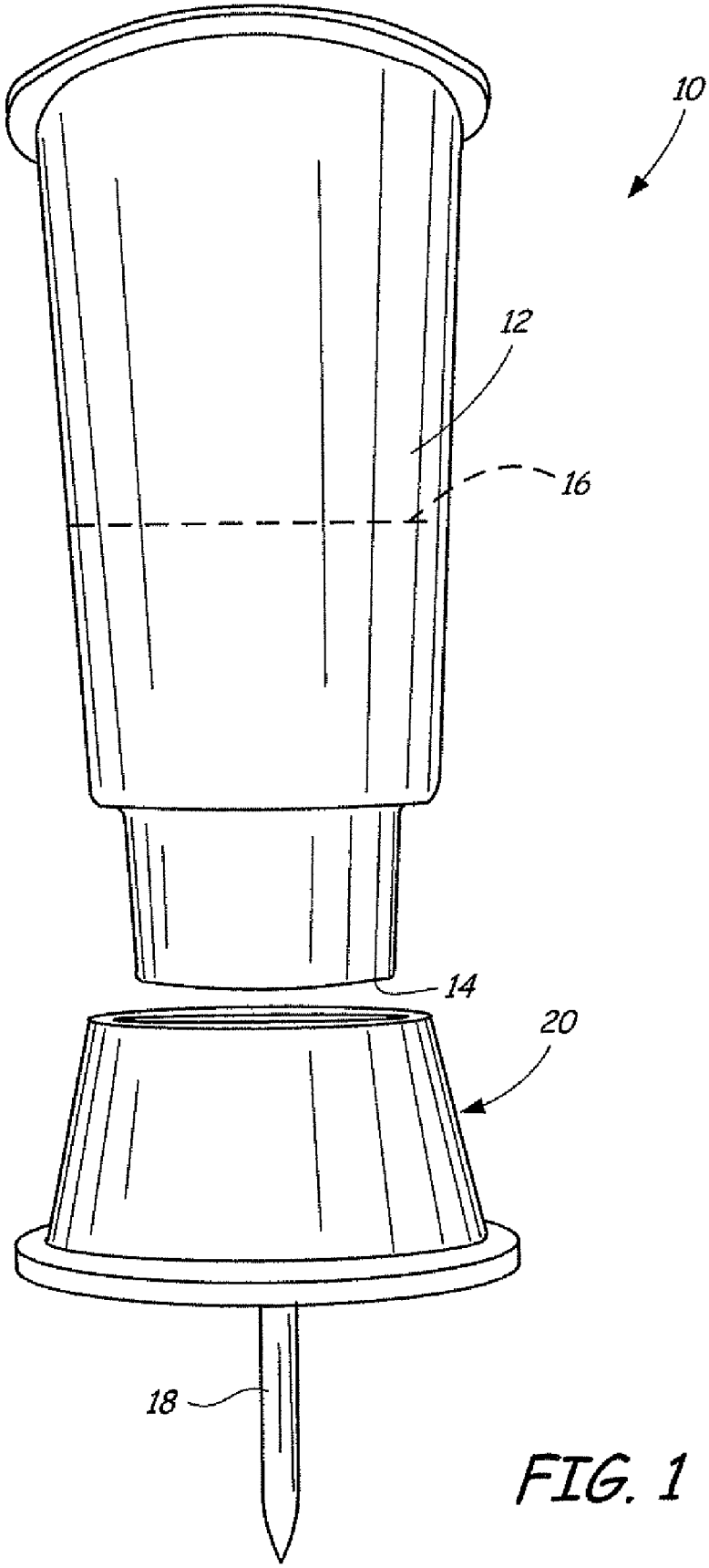
FIG. 1 is a perspective view of a first embodiment of a disposable vase.

FIG. 1 illustrates an exemplary form of a disposable vase 10 having aspects of the present invention. The vase 10 includes a wall 12 and a bottom 14. Plastic vases have been known for a long time, however, never the possibility of manufacturing robust disposable vases made of a biodegradable plastic was acknowledged. Thus, in case it ends up as street litter, the disposable vase will be a nuisance for a shorter period of time. The improved disposable vase may also be designed in more shapes than the known vase. Where in the present application reference is made to "wall of the vase", this also includes the bottom 14. The phrase "the polymer has a thickness that allows the vase to retain its shape" means that deflection caused by a force is for the most part limited by the polymer. A suitable thickness is, for example, at least 1 mm, and will in practice often be chosen between 2 mm and 10 preferably between 2 and 7 mm. A lower thickness, such as between 1 and 4 mm, may be preferred for vases having a higher degradability, which comes with a saving of costs and materials as well. However, even a thickness below 1 mm is possible, such as 0.5 to 1 mm.

If desired, vases having a very thin wall can have reinforcement ribs or the like. In one advantageous embodiment, the vase has a capacity of at least 400 ml, preferably at least 600 ml, and more preferably a capacity of at least 750 ml such as at least 1200 ml. However, a lower capacity, such as about 100 ml, is also possible.

The biodegradable polymer is preferably a polyester, and is preferably a polyester produced by micro-organisms or synthesised by means of organic chemistry. Examples of suitable polymers derived from starch are Mater-Bi™, Ecoflex™ etc.

According to an embodiment the biodegradable polyester is selected from polylactates (PLA), polyhydroxy(C4-C12) alkanoate or mixtures thereof.

The biodegradable polymer further can include a protein. For example, the biodegradable polymer is selected from starch, polylactate, and protein or mixtures thereof. The protein preferably is gluten, more preferably wheat gluten. Such protein-containing polymer compositions are for instance described in WO 2007/063361, which is incorporated herein by reference in its entirety.

The inclusion of protein in the biodegradable polymer can aid in allowing a decrease in the thickness of the wall of the disposable vase. For example, a thickness below 1 mm is possible, such as 0.5 to 1 mm.

The biodegradable polymer composition optionally may contain a silicate. The silicate preferably is in the form of nanoparticles. The silicate may be silica and/or magnesium silicate. Examples of polymer compositions comprising a silicate are given in WO 2007/099427, which is incorporated herein by reference in its entirety.

These vases can be manufactured relatively cheaply and offer a very adequate biodegradability. The excellent plastic properties of these polyesters also offer possibilities for use at home, since their environment-friendly character permits the owner of the vase to discard, without feeling embarrassed, a vase that he or she considers less beautiful or of which he or she is tired, and to buy another vase according to the invention with a more attractive appearance. This aspect of the invention thus enables an extension of the market for vases.

The polyhydroxy(C4-C12)alkanoate is preferably selected from polyhydroxybutanoate, polyhydroxyoctanoate, polyhydroxyvalerate and mixtures thereof.

If desired, the polyester includes starch or a starch derivative as an excipient.

In this way, the biodegradability can be influenced. In addition, such an excipient is cheap. The wall of the disposable vase may have more than 1 layer with biodegradable plastics. For example, a layer comprising starch or a starch derivative can be sandwiched between two others layers of biodegradable polymer that contain no or less starch or starch derivatives.

According to an important embodiment the disposable vase is a vase that is manufactured using injection molding.

According to an advantageous embodiment the vase 10 is provided with a coating of a biodegradable wax on its interior wall 12 and/or interior bottom 14 surfaces. In one embodiment, at least the lower half of the interior of vase 10 is provided with the biodegradable wax, which is indicated by dashed line 16.

This permits the use of biopolymers having a high degradability and the guarantee of quickly degrading once the coating is sufficiently affected/the water has permeated the hydrophobic coating. The wax is preferably a natural wax, such as bee wax, carnauba wax or the like. The molten or dissolved wax can be applied as a coating using a spraying technique.

Figure 2:
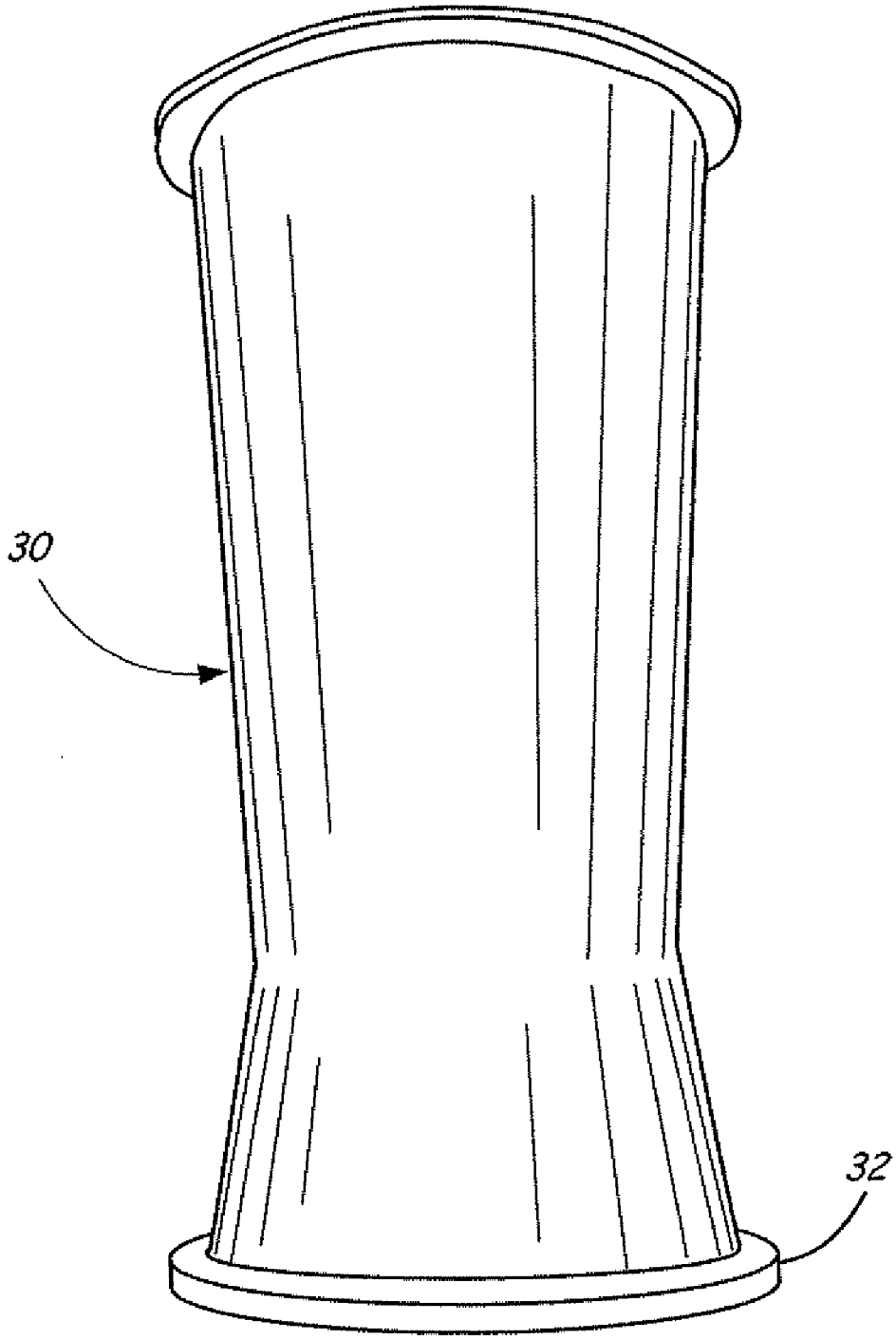
FIG. 2 is a perspective view of a second embodiment of a disposable vase.
Figure 3:
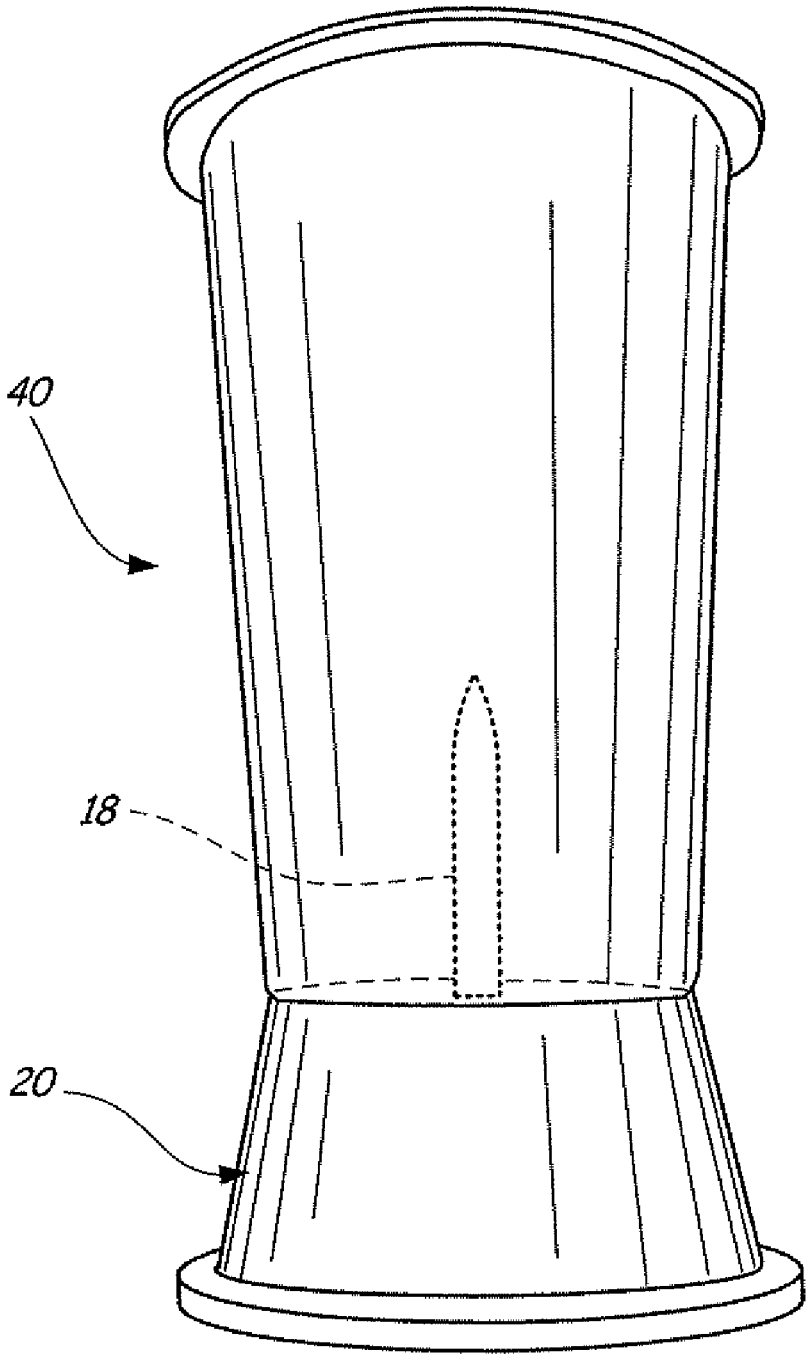
FIG. 3 is a perspective view of a third embodiment of a disposable vase.

According to another important or advantageous embodiment, the disposable vase has at its underside a point 18 with which the disposable vase 10 can be stuck into the ground, for example at a cemetery. The point 18 can integral (being formed of a single unitary part) with the wall 12 and bottom 14, or be part of a separate foot 20 (as illustrated) into which the disposable vase 10 can be placed. According to a first variant illustrated in FIG. 2 such a vase 30 has a bottom 32 that may be used without the foot for placement on a flat base (such as a window sill, table or tombstone) and according to a second variant illustrated in FIG. 3 a vase 40 has to be used in combination with the foot 20 for placement on a flat base also. For placing it into the ground, in the case where the bottom 14 is used in combination with the foot 20, the vase 10 is placed with its bottom 14 in and/or over the separate foot 20 having the point 18, such that the point 18 is facing the direction opposite from the bottom 14 of the vase. In the case where the disposable vase 40 is placed on a flat base, the use of the foot 20 can either be abandoned or, in the case where the foot 20 has a point 18, the foot 20 can be oriented such that the point is faces the lumen of the disposable vase and/or upwardly, where if desired it can be configured to be inserted therein. In the latter case, it is conceivable that the foot 20 constitutes the bottom of the disposable vase, provided that the wall of the disposable vase 40 and the foot 20 can be clasped to each other in a sealing manner. Otherwise, a suitable cavity can be provided in the bottom 14 of the vase to receive the point 18 when it is oriented upwardly.

Figure 4:
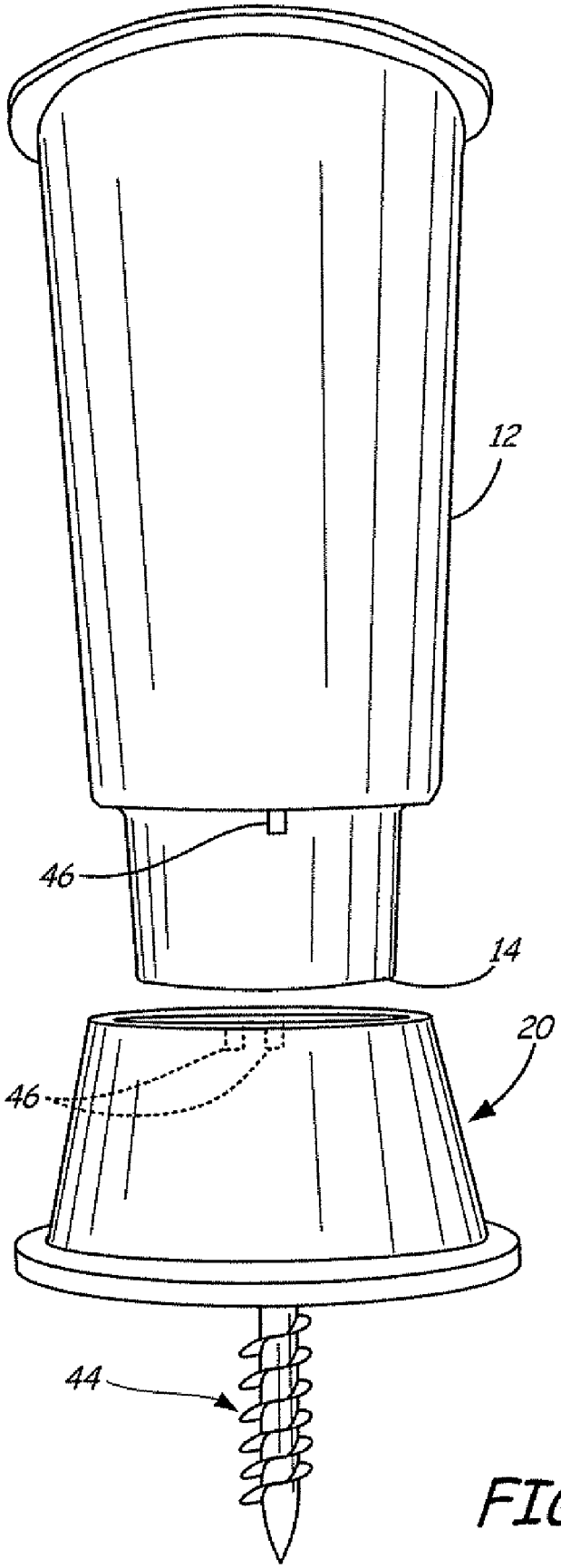
FIG. 4 is a perspective view of a fourth embodiment of a disposable vase.

According to an interesting embodiment, the point in any of the afore-mentioned embodiments can comprises a screw thread 44 (FIG. 4) which enables the disposable vase to be screwed into the soil. Thanks to the sturdy walls 14 and/or the foot 20, in comparison to the known disposable vase, and the large torque that can be achieved with a vase according to the invention having dimensions that are customary for a vase, it readily passes into the ground. In such a case, in order to avoid that the foot 20 and the wall 12 or bottom 14 of the disposable vase are separated because of the large torque, in one advantageous embodiment, the disposable vase preferably consists of a single part or the foot and the bottom of the disposable vase engage in circumferential direction with one or more sets of suitable engaging surfaces 46 (the shape of which can take many forms) between the foot 20 and the bottom 14 and/or walls 12 so as to transfer torque.

EXAMPLE 1

For manufacturing a biodegradable vase having walls with a thickness of 1.7 mm, Biopearls (www.biopearls.cto; TDI-Wageningen, Wageningen, The Netherlands), a polylactate, is molten with an extruder and introduced in an injection mold. Particulars:

Melting temperature 200° C.
Introduction hopper 20° C.
Introduction zone 155° C.
Compression zone 195° C.
Pressure zone 205° C.
Nose 205° C.
Temperature of the mold 15-25° C.
Screw speed 100-175 rpm
Screw back pressure 5-10 bar
Injection speed medium high

EXAMPLE 2

For manufacturing a biodegradable vase having walls with a thickness of 1.25 mm, Cereplast (CP-Inl-1001-EZ) of Hawthorne, Calif., a polymer composition comprising polylactate, starch, protein and silicate, is molten with an extruder (Oima 190 tonne) and introduced in an injection mold. Particulars:

Barrel temperature 200° C.
Hotrunner nose: 200° C.
Injection speed 99%, 195 bar
Realized injection speed 0.3-0.7 sec
Back pressure time 0.9 sec
Cooling time 10 sec
Cycle time 17.5 sec
Product weight 91.4 gram
melt flow index (MFI) of 35

It goes without saying that an ordinary person skilled in the art can determine suitable production conditions for producing a biodegradable vase desired by this person skilled in the art, using the above data and his ordinary professional knowledge as a guidance. The biodegradable vase can also be molded from, for example, Mater-Bi (Novamont S.p. A., Novara, Italy); information about the settings required for the injection molding as provided by the manufacturer can be taken as a starting point. In order to apply a coating, bee wax is dissolved and sprayed into the vase by using a nozzle that is introduced in the vase.

Although the subject matter has been described in language specific to certain compositions, structural features and/or methodological acts, it is to be understood that the subject matter defined in the appended claims is not necessarily limited to the specific compositions, features or acts described above as has been determined by the courts. Rather, the specific compositions, features and acts described above are disclosed as example forms of implementing the claims.

What is claimed is:

1. A disposable vase comprising biodegradable material, wherein the disposable vase has a wall which is made of a plastic selected from a biodegradable polymer selected from a polyester and a polymer derived from starch or a mixture thereof, wherein the polymer has a thickness that allows the vase to retain its shape.

2. The disposable vase according to claim 1, wherein starch or a starch derivative is included in the polyester.

3. The disposable vase according to claim 1, wherein at least the lower half of an interior surface of the vase is provided with a coating of a biodegradable wax.

4. The disposable vase according to claim 1, wherein the wall has a thickness of 1 to 10 mm.

5. The disposable vase according to claim 1, wherein the wall has a thickness of 1 to 7 mm.

6. The disposable vase according to claim 1, wherein the wall has a thickness of 0.5 mm to 4 mm.

7. The disposable vase according to claim 1, wherein the biodegradable polymer is a polyester selected from polylactates, polyhydroxy(C4-C12)alkanoate or mixtures thereof.

8. The disposable vase according to claim 7, wherein the polyhydroxy(C4-C12)alkanoate is chosen from polyhydroxybutanoate, polyhydroxyoctanoate, polyhydroxyvalerate and mixtures thereof.

9. The disposable vase according to claim 8, wherein starch or a starch derivative is included in the polyester.

10. The disposable vase according to claim 7, wherein starch or a starch derivative is included in the polyester.

11. The disposable vase according to claim 1, wherein the disposable vase has a point at its underside.

12. The disposable vase according to claim 11, wherein the point is part of a separate foot into which the vase can be placed.

13. A disposable vase comprising biodegradable material, wherein the disposable vase has a wall which is made of a plastic selected from a biodegradable polymer selected from a polyester and a polymer derived from starch and a protein or a mixture thereof, wherein the polymer has a thickness that allows the vase to retain its shape.

14. The disposable vase according to claim 13 wherein the protein is gluten.

15. The disposable vase according to claim 14 wherein the protein is wheat gluten.

16. The disposable vase according to claim 13 wherein the polymer includes silicate.

17. The disposable vase according to claim 16 wherein the silicate is silica and/or magnesium silicate.

18. The disposable vase according to claim 17 wherein the silicate is in the form of nanoparticles.

19. A method for making a vase, the method comprising injecting moulding a vase having a wall which is made of a plastic selected from a biodegradable polymer selected from a polyester and a polymer derived from starch or a mixture thereof, wherein the polymer has a wall thickness that allows the vase to retain its shape.

20. The method of claim 19 and further comprising coating a lower half of an interior surface of the vase with a biodegradable wax.

21. The method of claim 19 wherein the polymer includes a protein.

22. The method according to claim 21, wherein the wall thickness is in the range of 0.5 mm to 4 mm.

23. The method according to claim 19, wherein wall thickness is in the range of 1 to 10 mm.

24. The method according to claim 23, wherein the wall thickness is in the range of 1 to 7 mm.

* * * * *